US009022833B2

(12) United States Patent
Deming

(10) Patent No.: US 9,022,833 B2
(45) Date of Patent: May 5, 2015

(54) GARMENT FOR A PATIENT UNDERGOING RADIATION THERAPY OR OTHER USES

(76) Inventor: Katelyn Anne Deming, Portland, OR (US)

( * ) Notice: Subject to any disclaimer, the term of this patent is extended or adjusted under 35 U.S.C. 154(b) by 77 days.

(21) Appl. No.: 13/592,657

(22) Filed: Aug. 23, 2012

(65) Prior Publication Data

US 2013/0217302 A1 Aug. 22, 2013

Related U.S. Application Data

(60) Provisional application No. 61/526,850, filed on Aug. 24, 2011.

(51) Int. Cl.
*A41C 3/00* (2006.01)
*A41D 13/12* (2006.01)

(52) U.S. Cl.
CPC ..... *A41C 3/0064* (2013.01); *A41D 13/1245* (2013.01)

(58) Field of Classification Search
CPC ..... A41C 3/0064; A41C 3/00; A41D 13/1245
USPC ..... 450/30–33, 36, 54–57; 2/267, 268, 73, 2/113, 109, 110, 114, 105, 106
See application file for complete search history.

(56) References Cited

U.S. PATENT DOCUMENTS

| | | | | |
|---|---|---|---|---|
| 4,398,538 | A | 8/1983 | Johnson | |
| 6,048,252 | A | 4/2000 | Sebring | |
| 6,234,867 | B1 | 5/2001 | Fanelli | |
| 6,443,805 | B1 | 9/2002 | Kirkwood | |
| 6,854,132 | B1 * | 2/2005 | Polzin | 2/104 |
| 7,878,880 | B2 * | 2/2011 | Hendrickson | 450/36 |
| 7,878,881 | B2 * | 2/2011 | Hendrickson | 450/36 |
| 2002/0121273 | A1 | 9/2002 | Nyilas | |
| 2004/0038621 | A1 * | 2/2004 | Vera | 450/36 |
| 2004/0166766 | A1 * | 8/2004 | Schneider et al. | 450/36 |
| 2005/0026540 | A1 * | 2/2005 | Schneider et al. | 450/36 |
| 2005/0208873 | A1 * | 9/2005 | Rothman | 450/36 |
| 2008/0000004 | A1 * | 1/2008 | Lucock | 2/104 |
| 2008/0022434 | A1 * | 1/2008 | Adelman | 2/104 |
| 2009/0265830 | A1 * | 10/2009 | Hendrickson | 2/104 |
| 2009/0265831 | A1 * | 10/2009 | Hendrickson | 2/104 |
| 2011/0086577 | A1 | 4/2011 | Fleischman-Ament | |

* cited by examiner

*Primary Examiner* — Gloria Hale
(74) *Attorney, Agent, or Firm* — Bert P. Krages, II

(57) ABSTRACT

A garment to be worn by a patient receiving radiation therapy or for other uses that includes an inner comfort layer and an outer support layer. The inner comfort layer covers the breast region of a wearer and provides a soft, comfortable material directly against a wearer's skin. The outer support layer, external to the inner comfort layer, is configured to provide support for breast tissue or prosthesis. The garment may include a de facto or sleeved pocket. The inner comfort layer and outer support layer may be configured as a camisole, dress, leotard, bathing suit, tank top, T-shirt, halter top or other style of garment.

21 Claims, 9 Drawing Sheets

Camisole
Front and Back Views
Mesh bra-pad/prosthesis pocket detail

Spaghetti strap

Straps / no hook

T shirt

Tank top

Bathing suit or leotard

Dress

GARMENT FOR A PATIENT UNDERGOING RADIATION THERAPY OR OTHER USES

CROSS REFERENCE TO RELATED APPLICATIONS

This application claims the benefit of U.S. Provisional Application No. 61/526,850, filed Aug. 24, 2011, entitled Camisole For A Patient Undergoing Radiation Therapy Or Other Uses and having the same inventor as above.

FIELD OF THE INVENTION

The present invention relates to garments such as camisoles and, more specifically, to camisoles that provide comfort, function, and ease of use for a person undergoing radiation therapy or related procedures for the treatment of breast cancer. While well suited for cancer patients, the comfort, function and ease of use aspects of the present invention are applicable to non-cancer treatment garments.

BACKGROUND OF THE INVENTION

The prior art is replete with examples of bras, camisoles and related garments that are designed to provide one or more of comfort, ease of use, aesthetic enhancement, and function to a person who is battling cancer. Representative patents include the following.

U.S. Patent Application Publication no. 2002/0121273, for a Breast Cancer Treatment Support Bra and issued to Nyilas, discloses a support bra for use after breast surgery that is designed to promote healing and reduce the chance of infection. The bra includes an angled side zipper to put-on and take-off with limited arm movement.

U.S. Pat. No. 6,048,252, for a Camisole for Mastectomy Patients and issued to Sebring, discloses a garment having a front Velcro-sealing opening and a plurality of pockets for prosthetics and for drainage tubes and bulbs.

U.S. Patent Application Publication no. 2011/0086577, for a Post-Surgery Bra and issued to Fleischman-Ament, discloses a bra having an elastic support band provided against a users skin. An inner lining extends outwardly from this band and a pair of molded half-cup supports are provided in the breast area.

U.S. Pat. No. 6,234,867, for Mastectomy Garments with Built-In Prosthetic Device and issued to Fanelli, discloses several garments each with a similar bra device that accommodates a variable size prosthetic.

While these and related cancer treatment garments have made a contribution to that field, in general they have not kept pace with advancements in breast cancer treatment technologies and practices. Due to advances in drugs, treatment techniques and early detection, more and more women are being treated with lumpectomy and radiation therapy instead of a mastectomy.

Radiation therapy typically causes significant irritation of the skin in the treated area, which is much akin to a sun-burn. The skin may feel raw, tender, and be sensitive to touch, rubbing or stretching.

One important feature that is lacking in prior art garments is comfort against the skin of the patient, particularly the "burned" skin of a patient receiving radiation therapy. Further needs include providing this comfort in a garment that supports the breast tissue and/or prosthesis, is aesthetically pleasing in appearance, is lightweight, may be cost-effectively manufactured and is versatile in its integration into other articles of clothing.

In addition to prior art garments that directly assist breast cancer patients, there are related prior art garments that are not specifically designed for breast cancer patients. These garments may disclose relevant function, comfort, ease of use and/or aesthetic features, and include the following.

U.S. Pat. No. 4,398,538, for a Womens Soft Fabric Garment with Integral Brassiere and issued to Johnson, discloses a garment having an inner layer with an inwardly disposed elastic support band. An outer fabric layer covers the inner layer and provides an aesthetic finish.

U.S. Pat. No. 6,443,805, for a Bra Shelf and application Thereof and issued to Kirkwood, discloses a bra support structure and outer layer garment combination. The bra support structure includes first and second front chest panels provided inward of an exterior aesthetic layer. The bra support structure includes pockets for breast enhancement pads.

These and like devices are disadvantageous, among other reasons, in that they do not provide a comfortable inner layer across the treatment impacted area of a wearer. For example, U.S. Pat. No. 4,398,538 discloses an elastic band 17 against the skin of a wearer that would be quite irritating to raw skin. Similarly, application publication number 2011/0086577 discloses an elastic band in approximately the same location, directly against the skin of a wearer in the sensitive treatment area.

A need exists for a post-radiation therapy breast support garment that emphasizes comfort against the skin of a wearer while providing functional support in the breast region, a pleasing appearance, and/or an efficient manner of fabrication.

A need further exists for non-medical specific garments that provide this comfort layer against a wearer's skin and a support exterior to the comfort layer. In general, prior art garments teach support adjacent a wearer's skin and an aesthetic layer to hide the support layer or mechanism.

SUMMARY OF THE INVENTION

Accordingly, it is an object of the present invention to provide a garment for patients undergoing radiation therapy or for other uses that prioritizes comfort against the skin of a wearer while at the same time providing adequate support for breast tissue and/or prosthesis.

It is another object of the present invention to provide such a garment that has an attractive appearance and/or may be put on or taken off with minimum aggravation of tissue around the breasts.

It is also an object of the present invention to provide such a garment that is constructed in a cost-effective manner and/or may be fabricated into a range of styles or types of garments, including, but not limited to, a camisole, dress, leotard, bathing suit, tank top, T-shirt, halter top, sports bra, sports tank, or other.

These and related objects of the present invention are achieved by use of a camisole for a patient undergoing radiation therapy or other uses as described herein.

The attainment of the foregoing and related advantages and features of the invention should be more readily apparent to those skilled in the art, after review of the following more detailed description of the invention taken together with the drawings.

DETAILED DESCRIPTION

Figure 2:
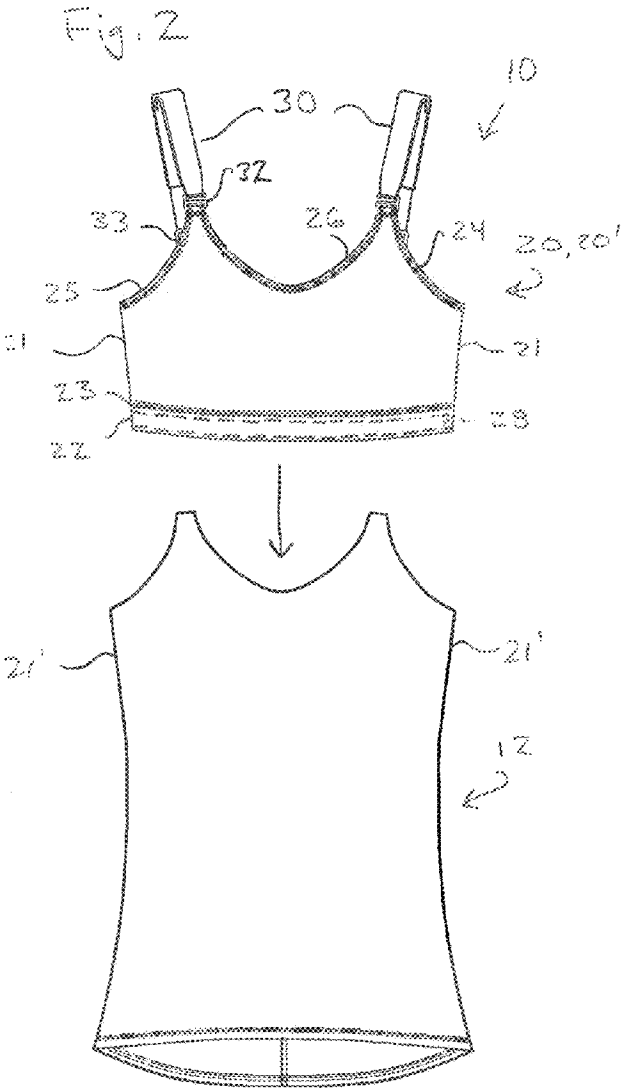
FIGS. 1 and 2 are a front assembled view and a front exploded view, respectively, of one embodiment of a garment in accordance with the present invention.
Figure 1:
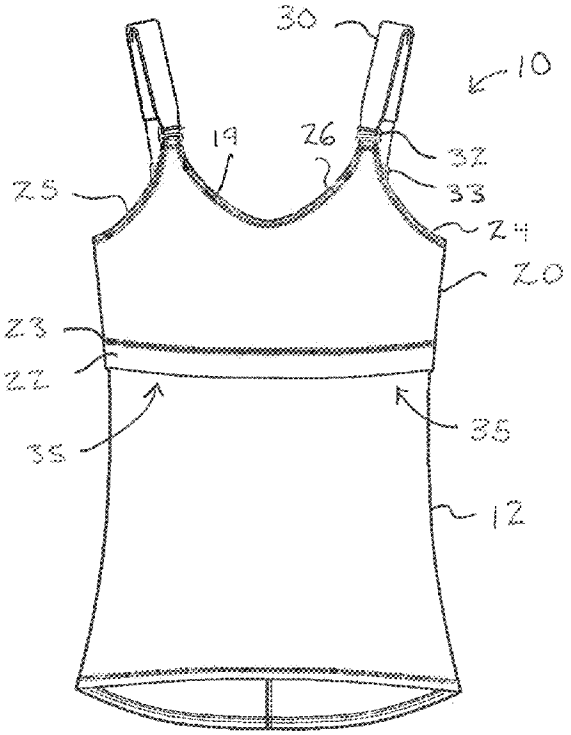
Figure 4:
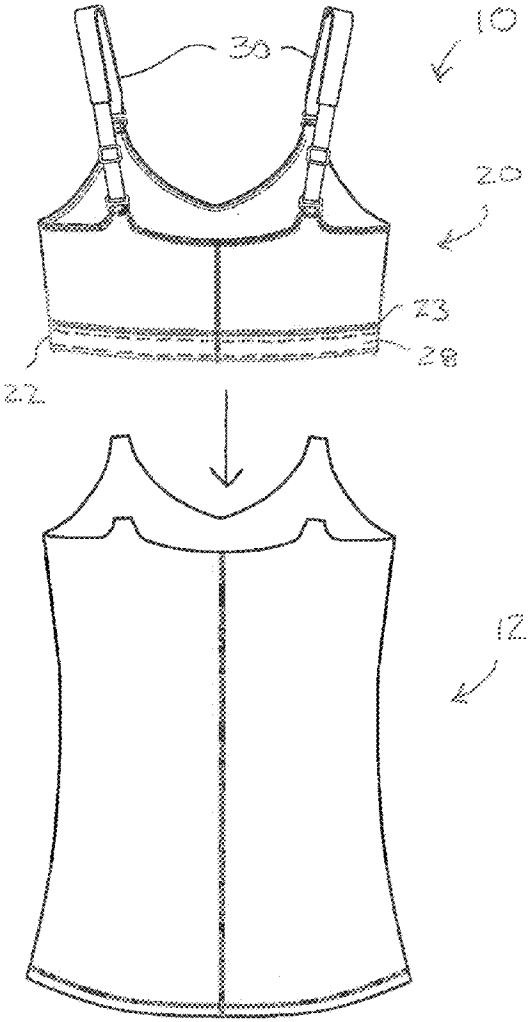
FIGS. 3 and 4 are a rear assembled view and a rear exploded view, respectively, of the garment of FIGS. 1 and 2.
Figure 3:
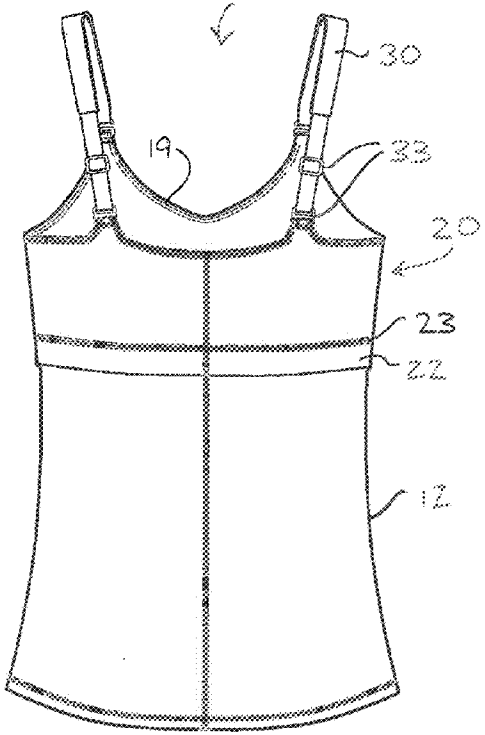

Referring to FIGS. 1 and 2, a front assembled view and a front exploded view of one embodiment of a camisole garment 10 in accordance with the present invention are respectively shown. Referring to FIGS. 3 and 4, a rear assembled view and a rear exploded view of the camisole garment 10 of FIGS. 1 and 2 are respectively shown. The embodiment illustrated in FIGS. 1-4 does not include lace or other ornamentation though this may be added as discussed below with reference to FIGS. 8 and 9.

Camisole garment 10 may include a base or inner comfort layer 12 that extends from over the breast region down toward a wearer's waist, and side ways to at least under the arms. Hence, the inner comfort layer covers the breasts and adjacent skin. In one embodiment, the inner comfort layer is continuous through the breast region and may terminate, for example, a few inches above the waist (e.g., near the navel), at the waist or below the waist of a wearer. Such a layer may be referred to as "full length".

Garment 10 also preferably includes an outer support layer 20 that extends over the breast region down to at least just under the breasts. An outer support layer terminating proximate the bottom of the breasts may be referred to as "half length".

Shoulder straps 30 or other shoulder borne straps or sleeves may be provided and they may include attachment and/or adjustment hardware 32,33. Shoulder straps 30 may be separate pieces of material as illustrated in FIGS. 1-2 or formed integrally with the inner and/or outer layer (see FIG. 18, for example).

Inner layer 12 is preferably formed of a material that feels comfortable against a person's skin. Examples include, but are not limited to, cotton, modal, rayon, microfiber lyocell (brand name microtensel) and blends of these materials, and other related materials. For example, a blend of modal and cotton (including micromodal and pima cotton) is one preferred inner layer material. Microfiber lyocell is another.

In addition to feeling comfortable against a person's skin, materials such as modal and cotton and/or microfiber lyocell have an elastic component and stretch with a person's movement, thereby increasing comfort. The elasticity also provides a measure of support to breast tissue. Furthermore, these and related fabrics also possess a breathability that further facilitates comfort when worn.

Spandex (AKA elastane) or a similar more elastic material may be included to provide enhanced elasticity to the inner (or outer) layer. The amount of elastane or the like may vary (typically less than 10%, though not necessarily). For example, in a garment designed to be worn immediately post-surgery, the amount of elastane may be increased so that garment 10 is more supportive (ie, the stretchiness of elastane permits a garment or component thereof to be more tightly fitting which conveys greater support). The amount of elastane or the like may be reduced in other versions of device 10, or it may not be used at all.

Outer support layer 20 may be formed of the same or a similar, or a different, material to that of inner layer 12. If formed of the same material, the two pieces will expand and contract with the same characteristics. Fabrication from the same material may also be beneficial in manufacturing (same source, same "feel" for hand or machine manufacture) and in laundering (same settings/cleaning conditions).

Outer support layer 20 may provide several beneficial attributes. As a second layer, outer support layer 20 increases the opacity of the garment in the breast region thus providing desired modesty/concealment for a wearer. Modesty may also be achieved or enhanced with thin bra pads (46 of FIG. 6) of the type used in padded sports bras and the like.

At the bottom of the outer support layer, an anchoring elastic band 28 may be provided (depending on the embodiment, materials used, environment or activity for which worn, etc.). The elastic band 28, also known as a chest band 28, encircles the chest of the wearer at the under bust and anchors the garment to the wearer when the chest band 28 is under tension This band 28 (shown in FIGS. 5 and 6) is concealed within a hem 22 in FIGS. 1-4) or may be otherwise attached (e.g., directly stitched to the outer support layer fabric). The band is shown in phantom lines in FIGS. 2 and 4. The hem may be formed by folding a bottom portion of the outer layer up and over the band and stitching this piece in place as shown with stitches 23. The hem 22 and band 28 preferably encircle a wearer and serve to both anchor the garment on a wearer and provide support under the breasts in a manner similar to some shelf bras.

If constructed of a material having elastic properties, outer support layer 20 can provide enhanced support to the breast region of a wearer (over band 28 alone). If the inner layer is also made of a material with elastic properties, then the combined support may be substantial (rendering band 28 unnecessary, see FIGS. 14 and 15). The elasticity, strength and support parameters of the inner and outer layers may vary and may be selected using practices/criteria known in the art.

Straps 30 may couple across and above the outer layer (though it should be recognized that the straps may be formed integrally with the outer or inner layer without departing from the present invention). These straps along with outer layer 20 (and/or inner layer) define arm holes 24,25 and a head hole 26. The straps may be made of the same material as the inner and/or outer layer or of a different material.

Attachment clasps 32 and adjustment buckles 33 may be of a kind known in the art. The straps are preferable made of a soft, washable material such as satin or the like, though may be made of silk (not as readily washable) or of cotton, modal, microfiber lyocell or blends or other material.

The top edge of inner comfort layer 12 and the outer support layer 20 (at the neck and arm holes) are aligned and fasten to one another by stitches 19 using techniques known in the art (seam concealment, reverse counter-stitching, etc.). This is the primary location and method of attachment of the outer layer to the inner layer. Hem 22, while stitched within the outer support layer, is preferably not stitched to inner comfort layer 12, at least in the breast region. In other words, the bottom edge of the outer support layer in the front is "free" or "unattached" to the inner comfort layer. This serves several purposes including permitting the outer layer to move freely relative to the inner layer in the breast region, thereby not pulling or tugging or otherwise providing uncomfortable stress or strain in the breast region, and providing access to a de facto pocket 35 or a sewn-in pocket 55 (FIGS. 10-12) for placement of a modesty pad or prosthesis.

The de facto pocket or pockets 35 may have a top border at stitches 19. The opening to this de facto pocket 35 is at the unattached hem 22. The hem and a section of the outer layer can be simply pulled away from the inner layer by a user and a pad 46 or prosthesis 48 slid up into place.

Figure 7:
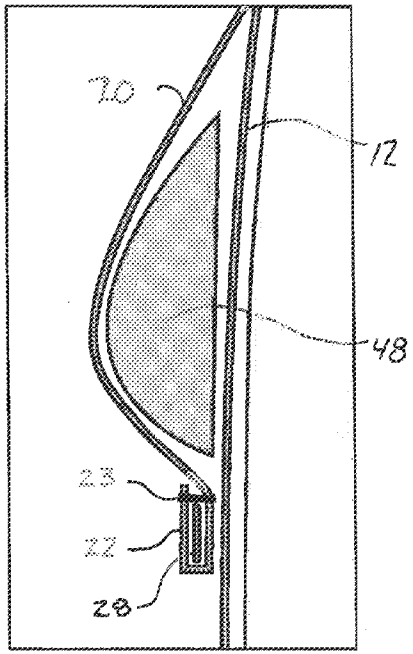
FIGS. 5, 6 and 7 are cut-away cross-sectional views of the garment of FIGS. 1 and 2 about a breast or breast region of a wearer.
Figure 6:
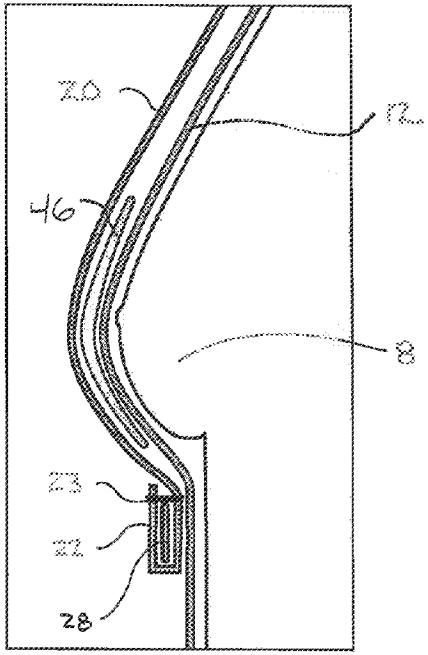
Figure 5:
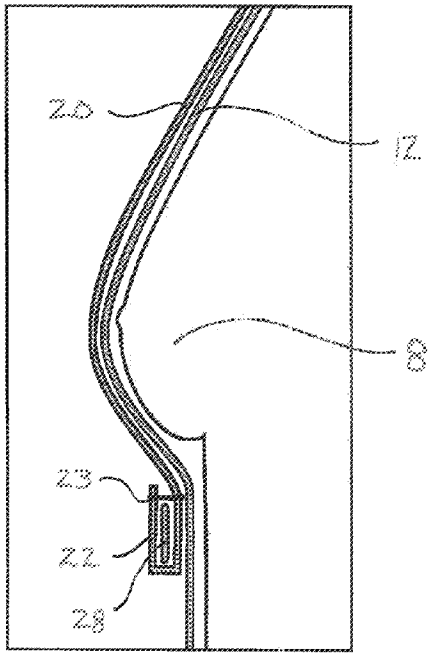

Referring to FIGS. 5, 6 and 7, cut-away cross-sectional views of garment 10 about a breast or breast region of a wearer are shown. In FIG. 5, outer support layer 20 is adjacent inner comfort layer 12. Both layers, due in part to their elastic properties, fit rather snuggly against each other and the breast 8 of a wearer, providing desired support, yet with the comfortable inner layer (preferably seamless in the breast region) gently contacting the wearer's skin. Hem 22 is positioned below the breast and both anchors the garment and provides support. Elastic band 28 is within hem 22.

In FIG. 6, a modesty pad 46 is inserted between outer support layer 20 and inner comfort layer 12. The pad provides modesty and/or fullness, while the comfortable seamless inner layer rests against the tender skin of the patient.

In FIG. 7, a prosthesis is inserted into pocket 35 between the outer and inner layers, while the comfortable seamless inner layer rests directly against a wearer's skin.

While garment 10 in the embodiment of FIG. 1-4 has an outer support layer that encircles the body of a wearer, it should be recognized that the present invention may include embodiments in which the outer support layer does not encircle the body, yet still provides adequate support and accessibility, etc., in the breast region. In such an embodiment, the outer support layer may terminate under the arms of a wearer or further back, up to encircling the wearer.

For example, the outer support layer may consist of the front portion shown in FIG. 2. This front portion 20' may be attached by stitches 19 (FIG. 1) at the head and arm holes (front side thereof) and under the arms of a wearer (at side edges 21). The side edges 21 of outer support layer 20' may be sewn or otherwise attached to the inner comfort layer at a corresponding location, represented by reference numeral 21'. The side edges 21 may be located approximately under the arm of a wearer, slightly behind the arm or further back, up to wholly encircling the body. Placing the side edges 21 at least somewhat behind the arm may remove a potential seam from the breast region.

Figure 9:
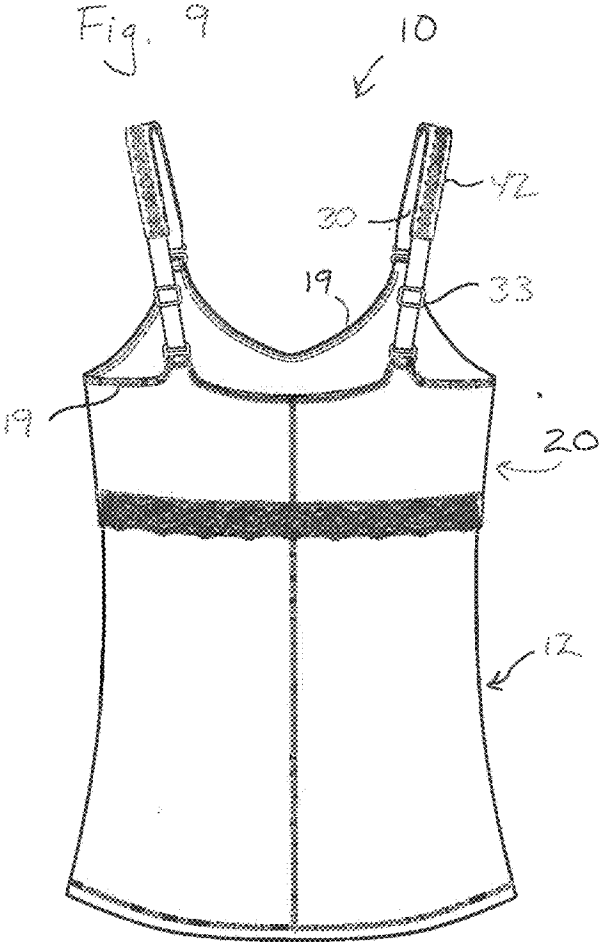
FIGS. 8 and 9 are a front and rear view, respectively, of the garment of FIGS. 1 and 2 with lace ornamentation.
Figure 8:
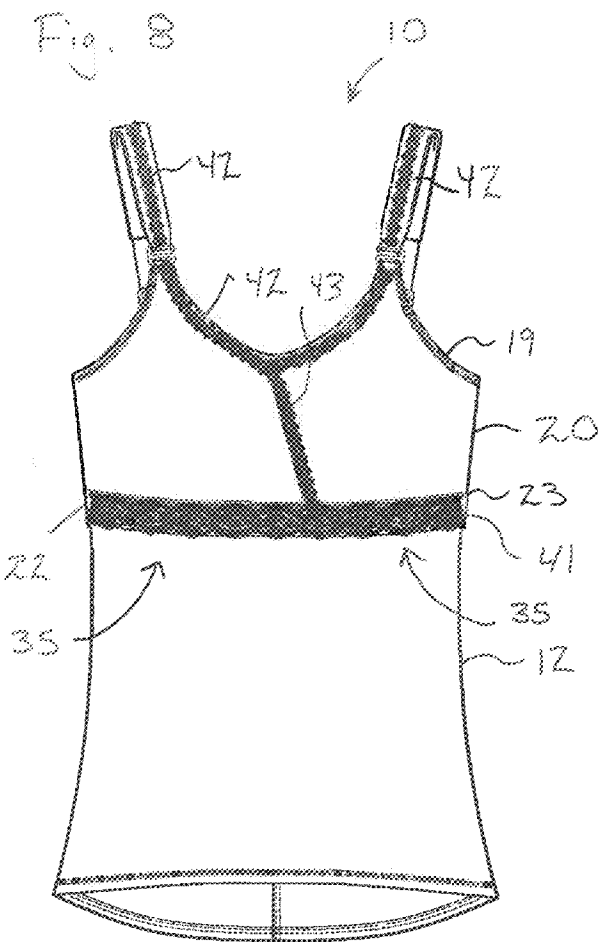

Referring to FIGS. 8 and 9, a front and rear view of a camisole garment 10 of FIGS. 1-4 with lace ornamentation added are respectively shown. A first piece of lace 41 may be coupled at hem 22 to mask the hem/seam and provide ornamentation. A second piece of lace 42 (thinner in the embodiments of FIGS. 8 and 9) may be provided along the top front edge of outer layer 20 (along neck hole 26) and on straps 30. FIG. 8 illustrates an ornamental lace piece traversing the breast region. While providing ornamentation, this piece may also help define separate left and right side pockets 35 (55 of FIGS. 10-12).

Figure 10:
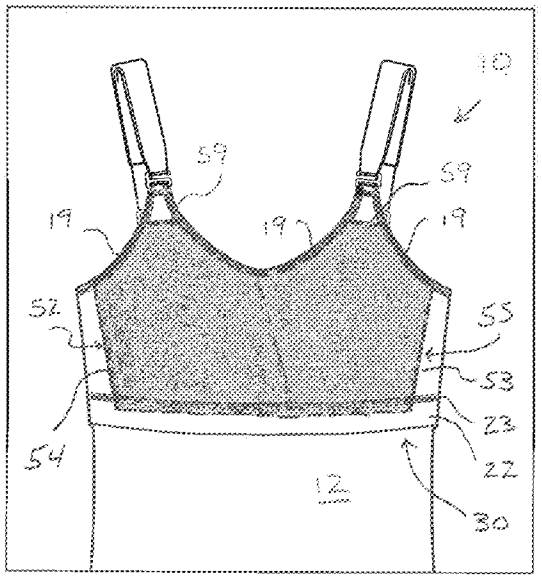
FIG. 10 is a partial front view of the garment of FIG. 1 with a sleeved pocket in accordance with the present invention.
Figure 11:
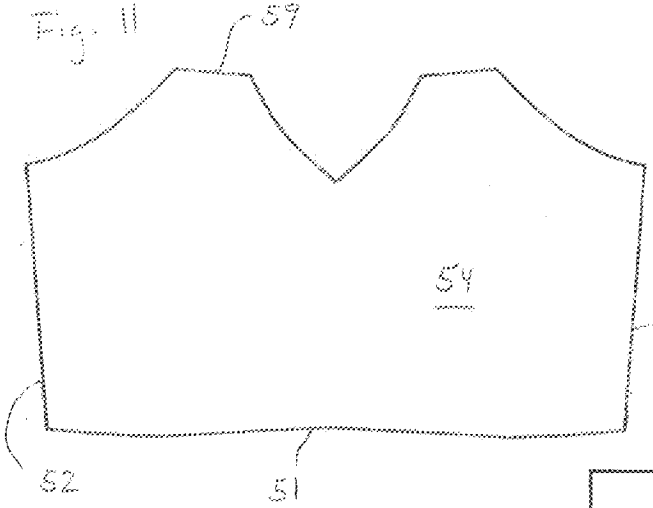
FIG. 11 illustrates an isolated pocket lining.
Figure 12:
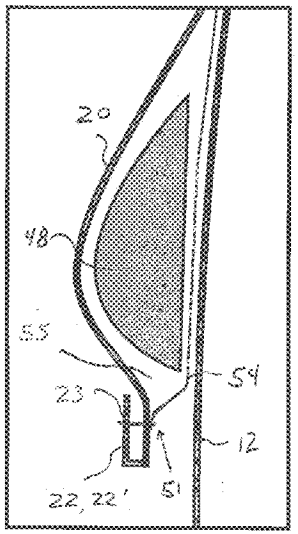
FIG. 12 is a cutaway cross-sectional side view of the garment of FIG. 10 with a prosthesis.

Referring to FIG. 10, a front view of camisole garment 10 with a sewn-in or "sleeved" bra-pad or prosthesis pocket 55 is shown. FIG. 11 is a front view of the liner 54 of sleeved pocket 55 in isolation, while FIG. 12 is a cross-sectional side view of garment 10 of FIG. 10 showing the pocket and liner.

Liner 54 may be made of any suitably durable yet supple and flexible material, including woven fabric, sheet material, mesh or other. In one embodiment, pocket 55 may be formed of a mesh material which may be a power mesh of approximately 80% nylon and 20% elastane, or another suitable mesh or other material. The power mesh material is breathable, lightweight, relatively strong and may offer friction beneficial to maintaining a pad or prosthesis in place, among other attributes.

In one method of assembly, liner 54 is placed between inner layer 12 and outer layer 20 and aligned substantially as shown in FIG. 10 (the liner is shown in phantom lines as it is under outer layer 20). These three components are then stitched (at stitches 19), though other coupling methods may be used without deviating from the present invention. Top edge portions 59 of the pocket may be unattached. A bottom 51 of the pocket may be secured to the outer layer by stitches 23 (just below the breast region). This is illustrated in FIGS. 10 and 12.

Pocket 55 effectively has right and left sides accessible through openings 52,53. These openings are preferably located under the arm of a wearer. In use, a wearer pulls the bottom of outer support layer 20 away from her body and inserts a bra pad or prosthesis into opening 52 and/or 53, then releases the outer support layer 20 which contracts onto the breast region to support and provide stability for pad or prosthesis. The support of the support layer effectively holds the pad and/or prosthesis in place, though separate or specifically shaped pockets or pads may be used.

Figure 14:
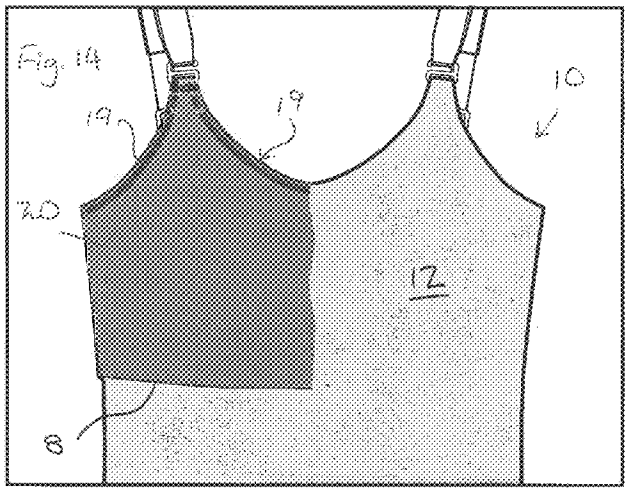
FIGS. 13-15 are partial front views of a garment with different outer support layers in accordance with the present invention.
Figure 13:
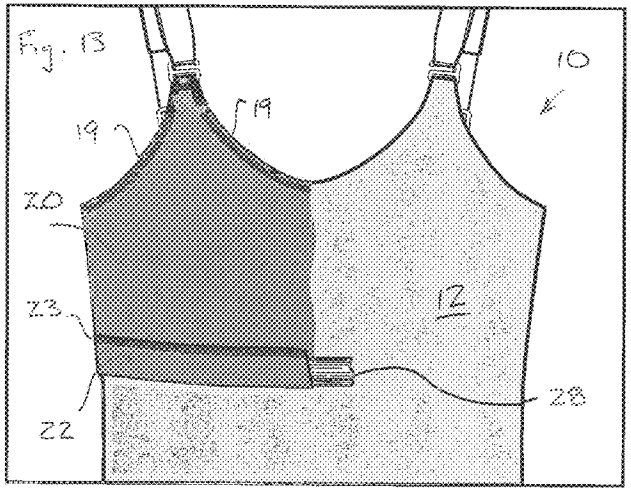
Figure 15:
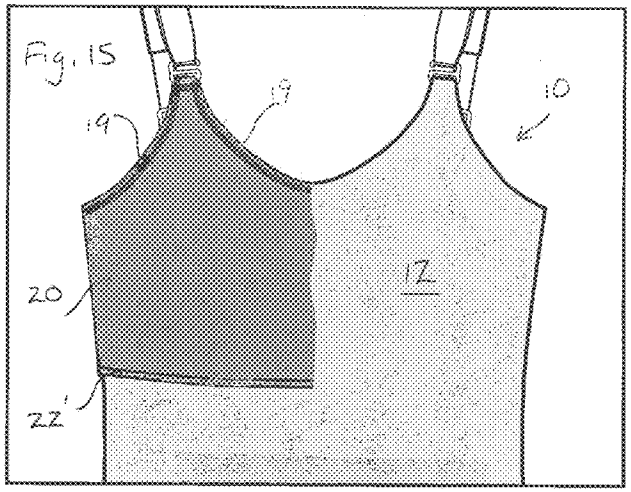

FIGS. 13-15 are three cut-away partial front views of garment 10, each with a different embodiment of the outer support layer 20.

In FIG. 13, outer support layer 20 is the same as shown in and described with reference to FIGS. 1-2. Elastic band 28 (see FIGS. 5-7) is seen extending from hem 22. Band 28 may be a conventional elastic band for support and/or anchoring.

In FIG. 14, the material from which the outer support layer 20 is formed is laser cut or otherwise processed to have a suitably finished/sealed edge 8 (ie, finished without a hem or the like). In the embodiment of FIG. 14, since elastic support band 28 is not present, the material of which the outer support layer is made preferably has (though not necessarily) a more pronounced amount of elasticity (for example, a higher elastane content) than, for example, an outer support layer with elastic band 28. In the embodiment of FIG. 14, the material of garment 10 preferably inherently gives sufficient support to a breast, pad and/or prosthesis and compensates, at least in part, for the absence of band 28 and/or a hem.

In FIG. 15, the outer support layer 20 has a hem 22', in which band 28 is not enclosed. Thus, hem 22' is not as tall as hem 22 (of FIG. 13). This smaller hem may be formed by folding under a small portion of the outer layer and stitching it in place. The elasticity of the thread preferably accommodates the elasticity of the fabric of the outer layer (in this and other embodiments). As in FIG. 14, the material of the outer layer may have (though not necessarily) more elasticity to compensate for the absence of band 28. The thinner hem 22' also provides a different stylistic appearance.

Figure 17:
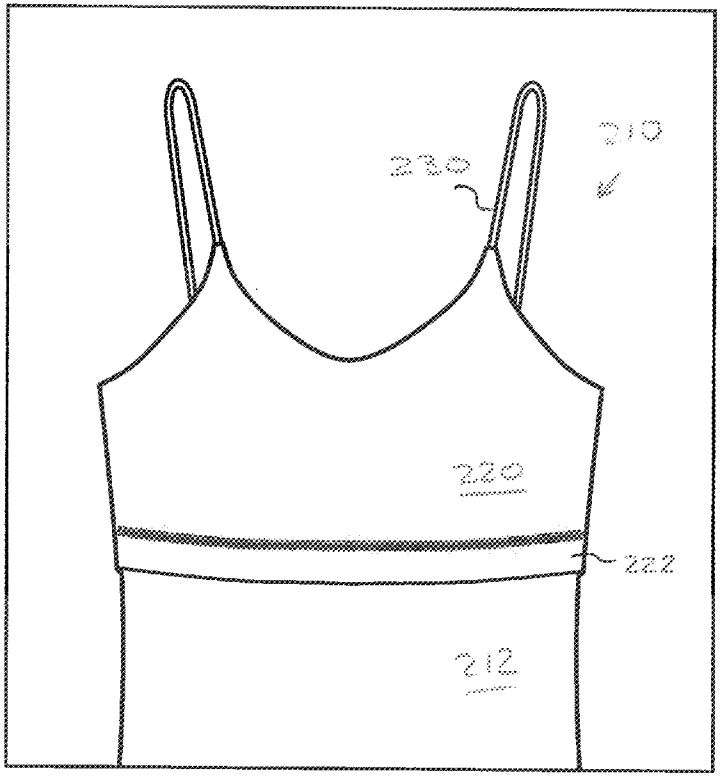
FIGS. 16-19 are partial front views of a garment with different strap and/or sleeve configurations in accordance with the present invention.
Figure 16:
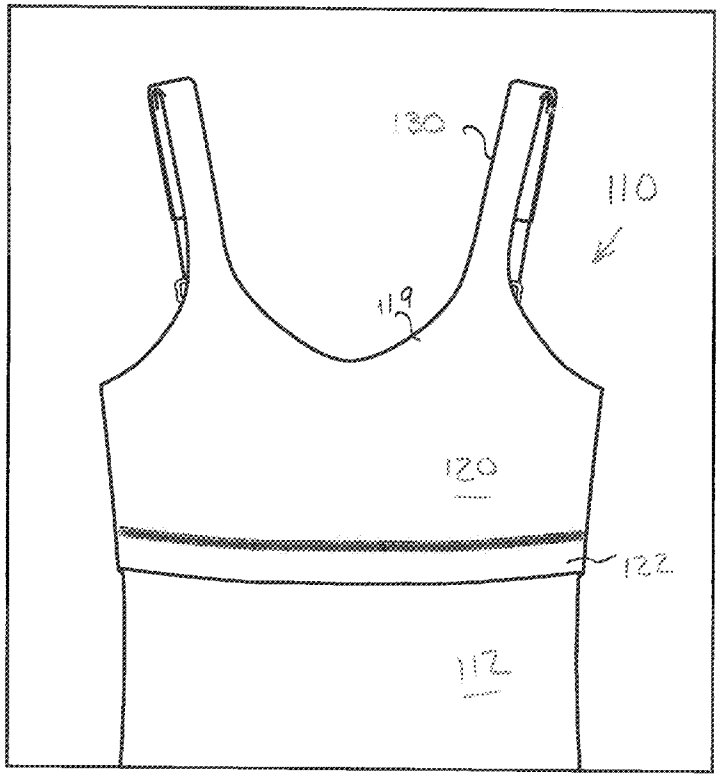

Referring to FIGS. 16-19, various garments are illustrated that have the inner comfort layer and outer support layer discussed above. FIGS. 16-17 illustrate camisole garments 110 and 210, respectively, one having ribbon like straps 130 with no hooks (yet having adjustments) and the other having spaghetti straps 230. Each of these garments has an inner comfort layer 112,212 and an outer support layer 120,220 similar to those of garment 10 of FIGS. 1-2 discussed above.

Each of these garments also preferably includes stitching 119,219, a hem 122,222, and an elastic band 128,228 (enclosed in the hem), etc.

Figure 19:
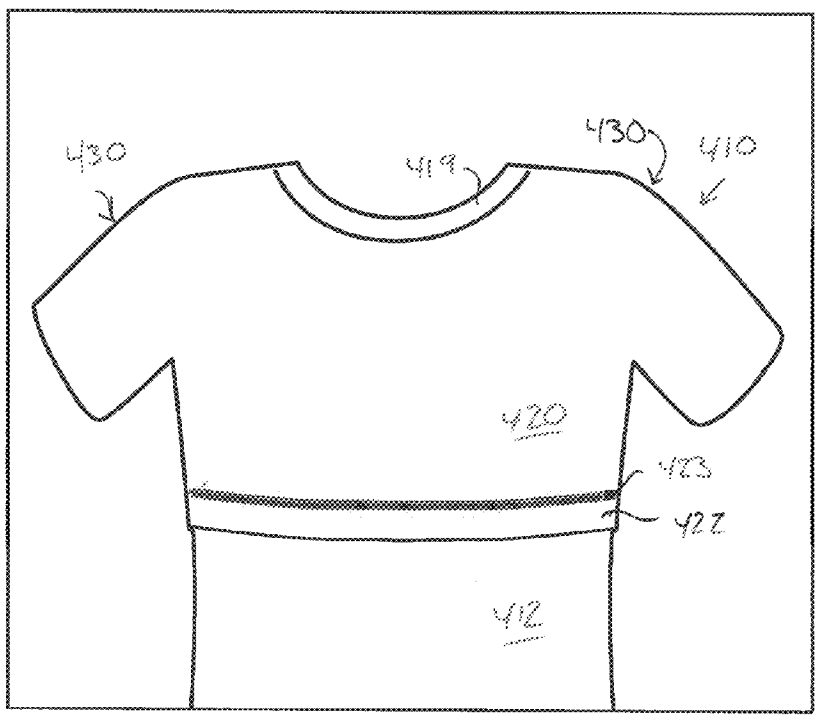
Figure 18:
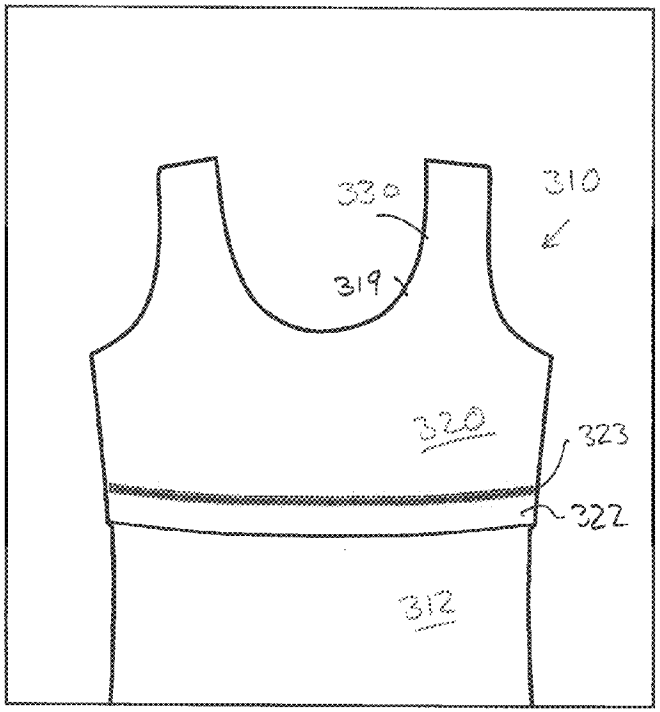

FIGS. 18-19 illustrate a tank top (or halter top) embodiment 310 and a T-shirt embodiment 410 of the present invention. Each of these garments as an inner comfort layer 312, 412 and an outer support layer 320,420, etc. They also include wider straps or sleeves 330,430, a hem 322,422, a band (obscured by the hem), and stitching 319,323,419,423, respectively, similar to like components discussed above in garment 10 of FIGS. 1-2.

It should be recognized that a garment of the present invention may have straps or sleeves, or like items, which may be referred to collectively as "shoulder borne tethers," since they contact the shoulder region of a user and the remainder of the garment hangs from or is "tethered" to them.

It should also be recognized that garments within the present invention may take the form of sports bras or sports tanks. For example, if, in the embodiments of FIGS. 1, 16 and 18, the inner comfort layer terminates close to hem 22,122, 322, then a sports bra or a sports tank may be formed. In these embodiments, the inner comfort layer may be approximately half to three-quarter length (i.e., the same length as in conventional sports bras and tanks). The bottom edge of the inner comfort layer may extend below and wrap up over hem 22,122,322 and be joined at the hem stitches (23) on the exterior side of the hem, or extend below and be unattached to the bottom of the outer support layer, or otherwise terminate.

Figure 21:
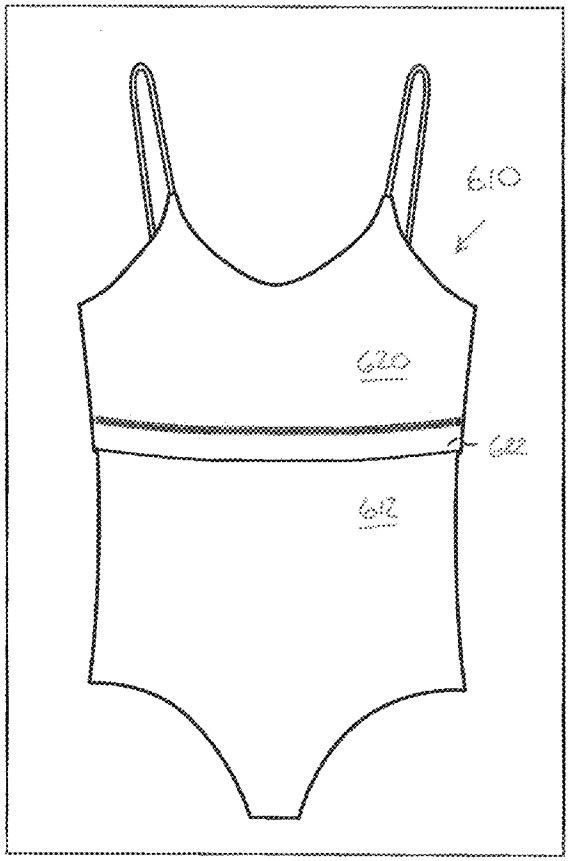
FIGS. 20-21 are front views of a dress and a bathing suit or leotard, respectively, that have an inner comfort layer and an outer support layer in accordance with the present invention.
Figure 20:
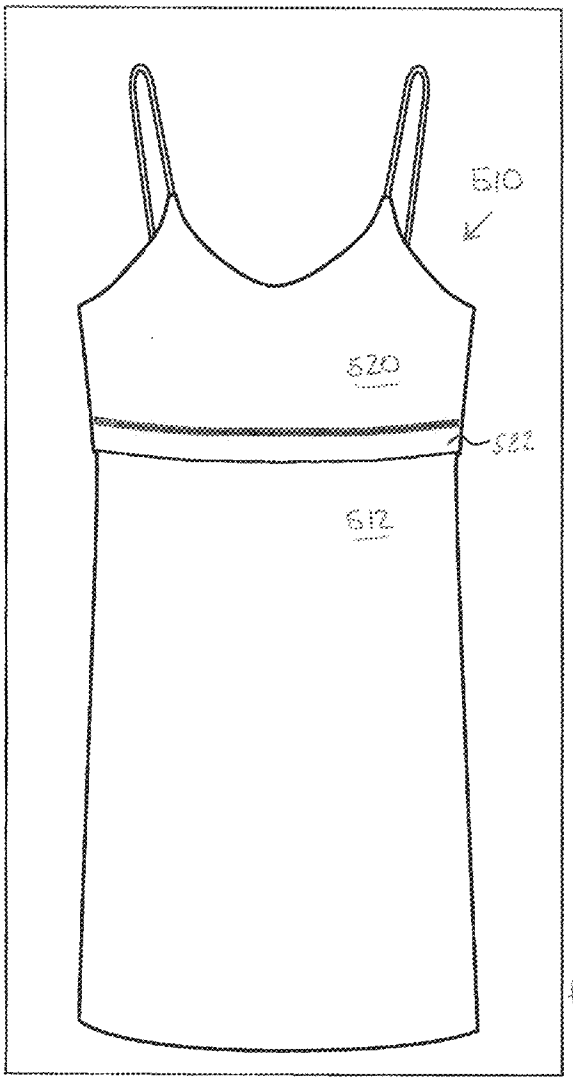

Referring to FIGS. 20-21, front views of a dress embodiment 510 and bathing suit/leotard embodiment 610, respectively, of the present invention are shown. Each of these garments includes an inner comfort layer 512,612 and an outer support layer 520,620 substantially as discussed or alluded to above or elsewhere herein.

The garments of FIGS. 16-21 are provided in part to illustrate that the present invention can be practiced in a number of different garment shapes and styles (whether for a cancer patient or non-cancer patient). The unique elements of the present invention include a smooth comfortable inner layer combined with a support providing outer layer, among other features and aspects.

The present invention also includes Referring to FIG. 1 and FIG. 18, the respective inner layers While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The invention claimed is:

1. A garment for a wearer having breasts and an under bust located directly under the breasts, and further having a torso, comprising:

an inner comfort layer having a front portion configured to cover the breasts and further configured to extend to the under bust with said front portion of the inner comfort layer being free of openings;

an outer support layer that is exterior to the inner comfort layer and configured to cover the front portion of the inner comfort layer, further having a chest band configured to fit at the under bust of the wearer;

a garment head opening and first and second arm openings;

wherein the inner comfort layer and the outer support layer are only fastened to one another proximate the head and arm openings; and wherein the outer support layer and the inner comfort layer are not fastened to one another over the breasts and at the under bust such that the inner comfort layer and outer support layer may move independently of each other at the chest band.

2. The garment of claim 1, wherein the chest band encircles the entire torso of the wearer at the under bust.

3. The garment of claim 1, wherein the chest band encircles at least part of the torso of the wearer at the under bust.

4. The garment of claim 1, wherein the outer support layer is made of fabric having elastic properties.

5. The garment of claim 1, wherein the outer support layer has a free bottom edge along the under bust and the inner comfort layer is seamless over the breasts of the wearer.

6. The garment of claim 1, wherein the inner comfort layer extends from the shoulders of the wearer to at least to the waist of the wearer and the outer support layer extends from the shoulders of the wearer to the under bust of the wearer.

7. The garment of claim 5 wherein the outer support layer and inner comfort layer form at least a first de facto pocket having an opening at the bottom edge of the outer support layer, and further comprising at least one of a bra pad and a prosthesis located within said de facto pocket.

8. The garment of claim 1, further comprising a sleeved pocket for at least one of a bra pad and a prosthesis provided between the inner comfort layer and the outer support layer in the breast region of a wearer, and further comprising at least one of a bra pad and a prothesis located in said sleeved pocket.

9. The garment of claim 1, wherein the inner comfort layer includes one or more of cotton, modal, rayon, and microfiber lyocell.

10. The garment of claim 1, wherein the outer support layer includes elastane.

11. A garment to be worn by a patient having breasts and an under bust located directly under the breasts, who is receiving radiation therapy, or for other uses, comprising:

an inner comfort layer continuous over the breasts of a wearer and extending lengthwise below the under bust;

an outer support layer that is exterior to the inner comfort layer;

first and second arm openings;

wherein the inner comfort layer and the outer support layer are sewn to one another above the breasts;

wherein the inner comfort layer and the outer support layer are not attached at the under bust so that the inner comfort layer and the outer support layer may move independently at the under bust;

wherein the inner comfort layer is free of openings over the breasts; and wherein the outer support layer includes material with elastic properties that is configured to support the breasts of a wearer.

12. The garment of claim 11, wherein the elastic propertied material includes one or more of:

an elastic band on the outer support layer located at the under bust; and a hem formed of the elastic propertied material to enhance the amount of support provided by said material in the breast region in which said material contains elastane.

13. The garment of claim 11, wherein the outer support layer has a free bottom edge, located on the front side of the garment along the under bust.

14. The garment of claim 13, wherein the outer support layer and inner comfort layer form at least a first de facto pocket having an opening at the bottom edge of the outer support layer, and further comprising at least one of a bra pad and a prosthesis located within said de facto pocket.

15. The garment of claim 11, further comprising a sleeved pocket for at least one of a bra pad and a prosthesis located between the inner comfort layer and the outer support layer in the breast region of a wearer.

16. The garment of claim 11 configured as one of a camisole, dress, leotard, bathing suit, tank top, T shirt, halter top, sports bra and sports tank.

17. A garment to be worn by a patient having breasts and an under bust, who has been treated with radiation therapy, or for other uses, comprising:

an inner comfort layer that covers the breasts and extends lengthwise beyond the bottom of the breasts of a wearer and encircles the upper torso of that wearer;

an outer support layer that is exterior to the inner comfort layer;

a head opening and first and second arm openings;

wherein the inner comfort layer and the outer support layer are sewn to one another proximate the head opening and the first and second arm openings;

wherein the inner comfort layer is free of openings over the breasts; and wherein the outer support layer includes material with elastic properties that is configured to support the breasts of a wearer, and the outer support layer has a free bottom edge, on the front side of the garment, so that the inner comfort layer and the bottom edge of the outer support layer may move independently at the under bust and over the breasts.

18. The garment of claim 17, wherein the elastic propertied material includes one or more of:

an elastic band located at the bottom edge of the outer support layer in the breast region; and a hem formed of the elastic propertied material to enhance the amount of support provided by said material in the breast region in which the elastic propertied material contains elastane.

19. The garment of claim 17, wherein the inner comfort layer is seamless at and immediately below the breasts of a wearer on the interior side of the garment.

20. The garment of claim 17 further comprising a sleeved pocket for at least one of a bra pad and a prosthesis located between the inner comfort layer and the outer support layer in the breast region of a wearer.

21. A method of increasing the comfort of a wearer having a head, two arms, one or more breasts afflicted with irritated skin, an under bust located directly under the breasts, and a torso, comprising the following steps:

a. the wearer pulls the garment of claim 1 over the head such that head is engaged within the head opening, the arms are engaged within the arm openings;

b. the wearer ensures the inner comfort layer encircles the torso such that no openings are located over the breasts; and b. the wearer pulls the outer support layer downward over the breasts such that the chest band is located over the torso at the under bust.

* * * * *